US008276213B2

(12) United States Patent
Maurer

(10) Patent No.: US 8,276,213 B2
(45) Date of Patent: Oct. 2, 2012

(54) VENTING APPARATUS WITH NO-CATCH MECHANISM

(75) Inventor: Kathryn Maurer, Alameda, CA (US)

(73) Assignee: The North Face Apparel Corp., Wilmington, DE (US)

( * ) Notice: Subject to any disclaimer, the term of this patent is extended or adjusted under 35 U.S.C. 154(b) by 883 days.

(21) Appl. No.: 12/108,249

(22) Filed: Apr. 23, 2008

(65) Prior Publication Data

US 2008/0263743 A1 Oct. 30, 2008

Related U.S. Application Data

(60) Provisional application No. 60/914,227, filed on Apr. 26, 2007.

(51) Int. Cl.
*A41D 3/02* (2006.01)
*A41D 27/06* (2006.01)

(52) U.S. Cl. ..... 2/97; 2/248; 2/255; 2/DIG. 1

(58) Field of Classification Search ..... 2/97, 102, 2/94, 227, DIG. 1, 247, 248, 254, 255, 256
See application file for complete search history.

(56) References Cited

U.S. PATENT DOCUMENTS

| | | | | | |
|---|---|---|---|---|---|
| 204,199 | A * | 5/1878 | Chow | 2/248 |
| 1,643,162 | A * | 9/1927 | Kirschenbaum | 2/248 |
| 1,982,845 | A * | 12/1934 | Wagman | 383/97 |
| 2,123,447 | A * | 7/1938 | Waite | 2/48 |
| 2,538,699 | A * | 1/1951 | McTighe | 2/260 |
| 2,614,261 | A * | 10/1952 | McTighe | 2/255 |
| 3,153,793 | A * | 10/1964 | Lepore | 2/93 |
| 4,513,451 | A * | 4/1985 | Brown | 2/69 |
| 4,608,715 | A * | 9/1986 | Miller et al. | 2/1 |
| 4,731,883 | A * | 3/1988 | Foster | 2/69 |
| 4,790,034 | A * | 12/1988 | Pass | 2/195.5 |
| 4,887,319 | A * | 12/1989 | Daniels | 2/410 |
| 5,105,477 | A * | 4/1992 | Golde | 2/93 |
| 5,529,823 | A * | 6/1996 | Aumann | 428/53 |
| 5,642,526 | A * | 7/1997 | Thompson | 2/79 |
| 5,704,064 | A * | 1/1998 | van der Sleesen | 2/69 |
| 5,727,256 | A * | 3/1998 | Rudman | 2/115 |
| 5,823,232 | A * | 10/1998 | Georgii | 139/383 R |
| 6,070,274 | A * | 6/2000 | van der Sleesen | 2/456 |
| 6,085,353 | A * | 7/2000 | van der Sleesen | 2/69 |
| 6,163,883 | A * | 12/2000 | Hong | 2/69 |
| 6,263,510 | B1 * | 7/2001 | Bay et al. | 2/93 |
| 6,263,511 | B1 * | 7/2001 | Moretti | 2/97 |
| 6,339,845 | B1 * | 1/2002 | Burns et al. | 2/243.1 |
| 6,766,565 | B2 * | 7/2004 | Crye et al. | 24/381 |
| 6,795,976 | B1 * | 9/2004 | van der Sleesen | 2/69 |
| 6,848,119 | B2 * | 2/2005 | Crye et al. | 2/247 |
| 7,017,191 | B2 * | 3/2006 | Golde | 2/93 |
| 7,043,767 | B2 * | 5/2006 | Jaeger | 2/87 |
| 7,169,249 | B1 * | 1/2007 | Nordstrom | 156/256 |
| 7,197,772 | B2 * | 4/2007 | Crye et al. | 2/247 |
| 7,284,282 | B2 * | 10/2007 | Bay | 2/93 |
| 7,412,728 | B2 * | 8/2008 | Alesina et al. | 2/93 |
| 7,540,037 | B1 * | 6/2009 | Bittler et al. | 2/69 |
| 2003/0033656 | A1 * | 2/2003 | Jaeger | 2/69 |
| 2005/0235392 | A1 * | 10/2005 | Bay | 2/93 |
| 2007/0157369 | A1 * | 7/2007 | Uchibori et al. | 2/255 |
| 2009/0178174 | A1 * | 7/2009 | Cash, Jr. | 2/69 |

* cited by examiner

*Primary Examiner* — Alissa L Hoey
(74) *Attorney, Agent, or Firm* — Kenyon & Kenyon LLP

(57) ABSTRACT

A venting apparatus with a no-catch mechanism and a method of manufacture of the apparatus are described. More particularly, embodiments of the present invention may comprise: a fastening device, a venting mechanism wherein the venting mechanism further comprises an opening, a mesh arrangement, and a no-catch mechanism.

11 Claims, 4 Drawing Sheets

FIG. 2A
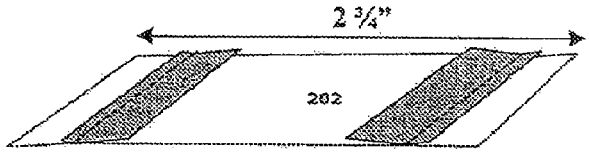
FIG. 2B
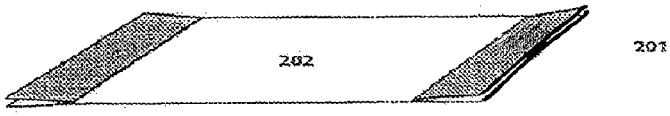
FIG. 2C
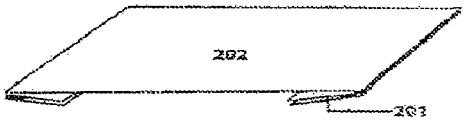
FIG. 2D
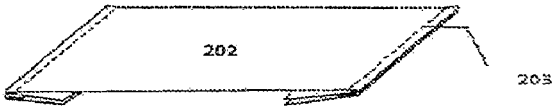
FIG. 2E
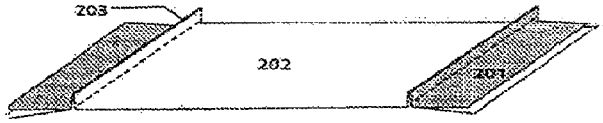
FIG. 2F
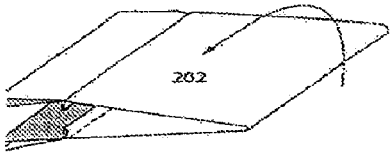
FIG. 2G
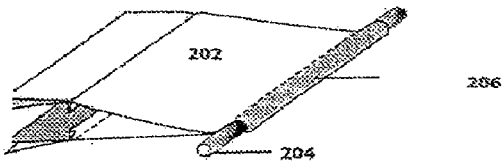
FIG. 2H
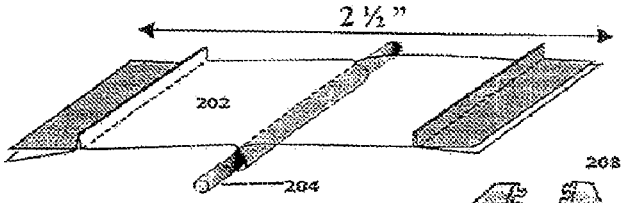
FIG. 2I
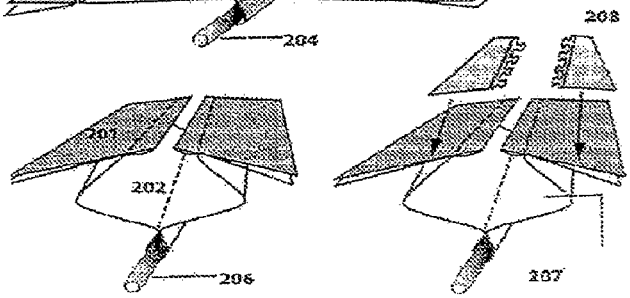
FIG. 2

VENTING APPARATUS WITH NO-CATCH MECHANISM

The present application claims the benefit of U.S. provisional application Ser. No. 60/914,227 filed on Apr. 26, 2007. The disclosure of the co-pending provisional application is incorporated herein by reference in its entirety.

BACKGROUND OF THE INVENTION

A. Field of the Invention

Embodiments of the present invention generally relate to fabric venting mechanisms. More particularly, embodiments relate to no-catch mechanisms that prevent a venting mechanism's integral fastener from catching fabric parts.

B. Description of the Related Art

The technical apparel industry is currently enjoying great success in the consumer environment. This may be attributed to a continuous flow of products embodying ever-increasing technical sophistication and customization. In recent years, apparel items such as jackets, shoes, and pants have been customized to fit a great number of activities (e.g., hiking, trail running, distance running). Each of these activities requires its own performance criteria and design considerations. Design considerations also may vary based on upon such criteria as gender, durability, and aesthetics.

Athletes enjoying outdoor sports are subject to the elements. To counter the elements, these athletes often need specialized technical apparel. The item's design considerations must be optimized to offer the most protection or relief from the elements, while still allowing the user to maintain high performance standards.

For example, trail running or hiking is often an all-day or multi-day activity during which the performer may encounter any number of changing weather conditions. A trail runner may utilize a jacket to counter the effects of chilly or rainy conditions. Today, many jackets are waterproofed or wind proofed to keep the trail runner warm and dry.

However, in addition to aiding the trail runner in remaining warm and dry, waterproofing or wind proofing a jacket inhibits the venting of accumulated body heat. In addition, it may inhibit evaporation of body moisture exuded during physical exercise. Unfortunately, conventional jackets may not be equipped with proper venting mechanisms to counter such accumulation of excess heat and moisture.

One way to improve the breathability of garments is to provide them with a means to ventilate. Venting mechanisms or ventilation ports typically consist of breathable material, and may be designed into various locations of the item of apparel. The venting mechanisms may be placed in isolated areas critical to relieving heat buildup and countering body moisture collection, and may comprise a fastener to close or open upon need.

In some embodiments, the ventilation ports may include fabric arrangements (e.g., a mesh arrangement) set underneath an opening and a fastener. The mesh gussets repel the elements when opened, yet allow heat to escape through the perforations in the fabric of the mesh gusset. An exemplary embodiment including common ventilation port placements is shown in FIG. 1. In this embodiment, the ventilation ports are placed in the underarm area of the jacket 101 and the outer thigh area of the pants 102. The mesh gusset 103 is detailed as well. As shown, a zippered ventilation port entry 104 is under a flap in two areas.

A frequent problem in utilizing a ventilation port mechanism is that the fastener (e.g., a zipper, a hook and loop fastener) often becomes attached (i.e., "catches") and entangled with the mesh fabric of the ventilation port during opening and closing. This may be inconvenient to those participate in outdoor sports, as it is especially difficult to undo in the heat of performance or competition. This inconvenience may be especially irritating for athletes wearing gloves, as gloves inhibit the dexterity required to correct the problem. In addition, the mesh fabric often tears or rips during forceful attempts to untangle the zipper.

Attempts were made to overcome this inconvenience. For example, apparel designers attempted to set the mesh fabric back a certain distance from a zipper by utilizing a shell fabric strip or "A" grosgrain ribbon patched over the mesh fabric just under the zipper. Typically, the center of the mesh fabric still turned inside-out and wandered up through the opening, thereby obstructing the zipper. Designers also added a stitched ⅛" pin-tuck or pleat down the center of the mesh fabric away from the zipper, resulting in inconsistent success.

Another attempt consisted of adding layers of cording or fabric strips set under the fastener and bridging across the two sides of the ventilation port. However, these added layers constituted bulk detrimental to those engaged in intensive outdoor sports. In addition, the added layers were also often inadvertently caught in various items, including the fastener.

BRIEF DESCRIPTION OF THE DRAWINGS

FIGS. 2A-2I illustrate an embodiment method for the manufacture of the no-catch mechanism;

DETAILED DESCRIPTION OF THE DRAWINGS

Figure 1:
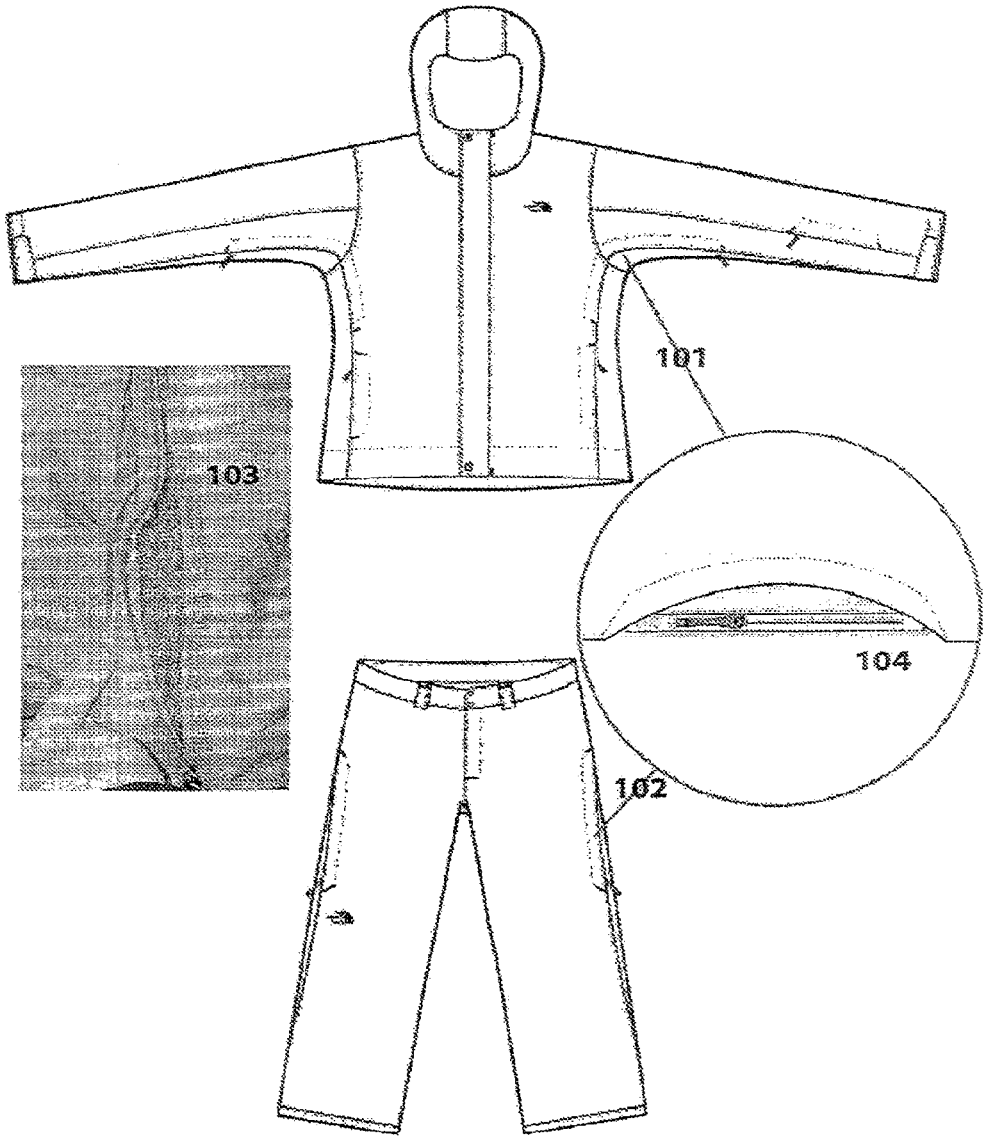
FIG. 1 provides an illustration of an exemplary jacket construction with a vent mechanism.

Aspects of the present invention relate to a no-catch mechanism that prevents a venting mechanism's integral fastener from catching fabric parts. Embodiment no-catch mechanisms may comprise an elasticized shock cord set along the interior center length of the mesh gusset on the opposite side of a fastener. An apparatus comprising the no-catch mechanism may be included in significantly different settings and still be within the scope of the present invention. Moreover, the specific configuration of the no-catch mechanism may vary significantly and still be within the scope of the present invention.

FIG. 2 illustrates an embodiment method for the manufacture of the no-catch mechanism. FIG. 2*a* illustrates shell fabric facings 201 set and joined along lengthwise edges of the mesh fabric of gusset 202. Shell fabric facings 201 may be set off a set distance (e.g., ½") away from the edges of mesh fabric. FIG. 2*b* illustrates shell fabric facings 201 folded over to meet the edges of mesh fabric 202. In FIG. 2*c*, the joined shell fabric facings 201 and mesh fabric 202 are folded "wrong" side to "wrong" side (i.e., in this case, folded toward the bottom), and along the seams. Next, the folded portions are edge-stitched 203 together as shown in FIG. 2*d*. After the edge-stitching is complete, the folded edge-stitched portions are opened back. This is called the "pintuck". See FIGS. 2*d* and 2*e*.

Next, a no-catch mechanism is inserted. First, as shown in FIG. 2*f*, the mesh fabric may be folded "right" side to "right" side (i.e., in this case, folded toward the top) and stitched, for example, to house no-catch mechanism 204. In this embodiment, no-catch mechanism 204 is an elastic cord (i.e., a "bungy" cord or shock cord). As shown in FIG. 2*g*, shock cord 204 may be inserted into the piping generally along the center of the mesh fabric gusset. In FIG. 2*g*, shock cord 204 is stitched closed using piping stitching 206 (as shown by the dotted lines). The piping stitched-shock cord 204 is shown in open form in FIG. 2*h*. When the two folded, edge-stitched pintuck portions are brought together (in a closed form), the shock cord aids in creating an enclosure (i.e., a "tent") to pull the gusset away from a fastener, such as, for example, zipper 208. See FIGS. 2*g* and 2*i*. In one embodiment, portions of zipper 208 may be attached to the two folded, edge-stitched pintuck portions (as shown).

In addition, an enclosure with walls extending outwardly 207 (i.e., an "accordion") is created by pintucks 203 and piping stitched shockcord 206, which operate to further distance the mesh fabric from the fastener, and thereby further preventing a fastener catch.

Figure 3:
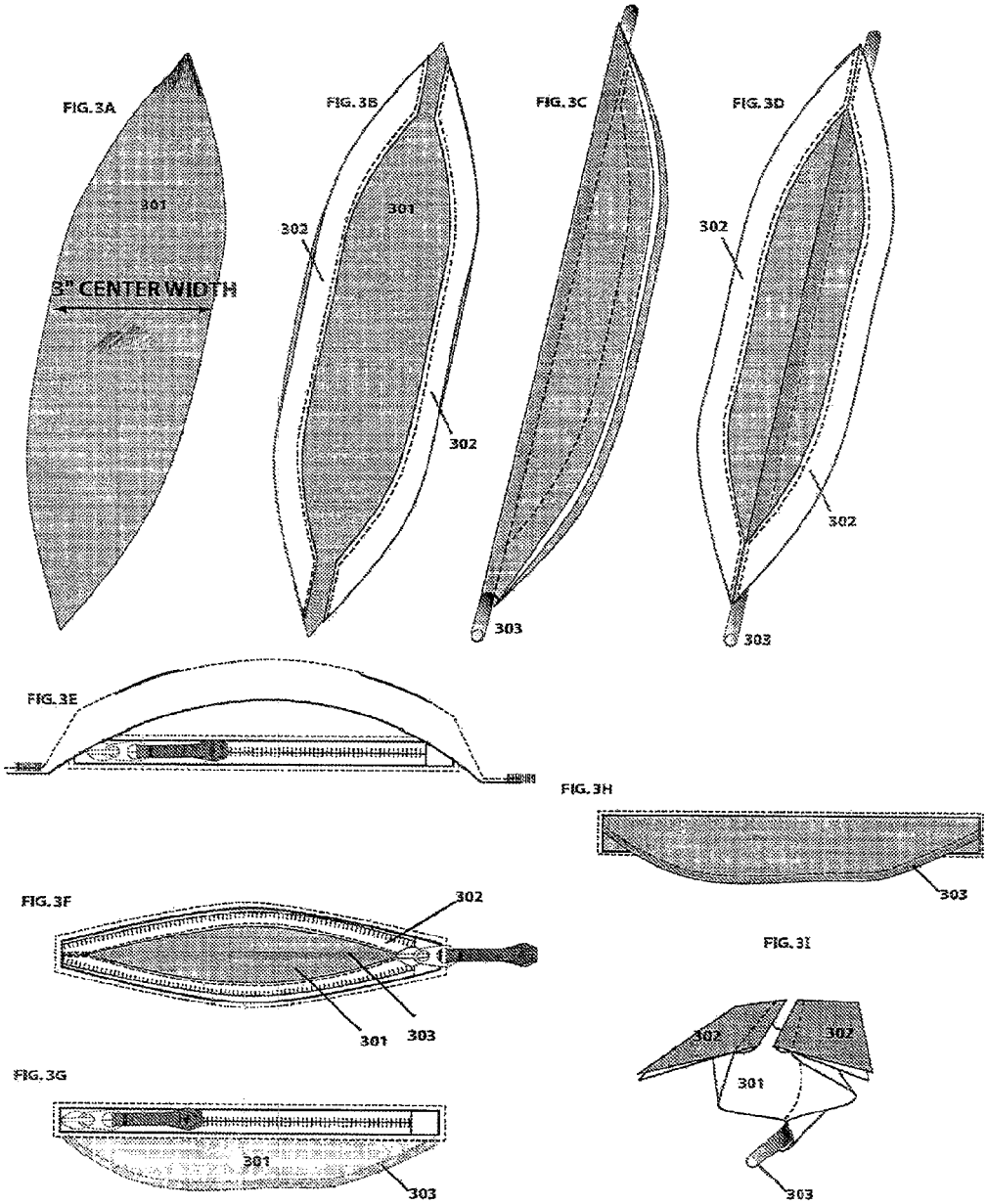
FIGS. 3A-3I illustrate a "fish-eye" or oblong shaped gusset embodiment comprising a no-catch mechanism.

Various shapes of gussets may be utilized with the no-catch mechanism. For example, FIG. 3 illustrates a generally oblong shaped (i.e., a "fish-eye") venting mechanism embodiment comprising a no-catch mechanism. Various views of "fish-eye" shaped mesh gusset 301 are shown in FIG. 3*a-h*. FIG. 3*a* illustrates mesh gusset 301 before sewing. FIG. 3*b* illustrates shell fabric facings 302 sewn to the edges of mesh gusset 301. In FIG. 3*c*, no-catch mechanism 303 is inserted. The mesh fabric is folded right-side to right-side (as shown) and stitched, for example, like piping to house no-catch mechanism 303. FIG. 3*d* illustrates a view of the mesh gusset embodiment including shell fabric facings 302 after no-catch mechanism 303 is inserted. In this embodiment, the shell fabric facings (the edges) and set off no-catch mechanism 303 combine to form an opening.

FIG. 3*e* illustrates a top view of an exemplary venting mechanism in closed position. FIG. 3*f* also illustrates a top view of the venting mechanism with the fastener opened (in this case, a zipper), exposing mesh gusset 301. No-catch mechanism 303 and shell facings 302 combine to form an opening that generally has an orientation concurrent to an orientation of the zipper fastener. As shown in FIG. 3*f*, the zipper fastener may completely surround the venting mechanism when unzipped. FIG. 3*g* illustrates a top view of the closed venting mechanism and mesh gusset 301, with no-catch mechanism 303 extending (or tenting) mesh gusset 301 away from the fastener. FIG. 3*h* illustrates a bottom view of the venting mechanism with no-catch mechanism 303 tenting the mesh fabric away from the fastener and shell facings 302. In one embodiment, pintucked shock cord 302 may be also designed to be shorter than the length of the zipper. This may cause shock cord 302 to lean toward one side of zipper 303 opening. See FIG. 3*i*.

Figure 4:
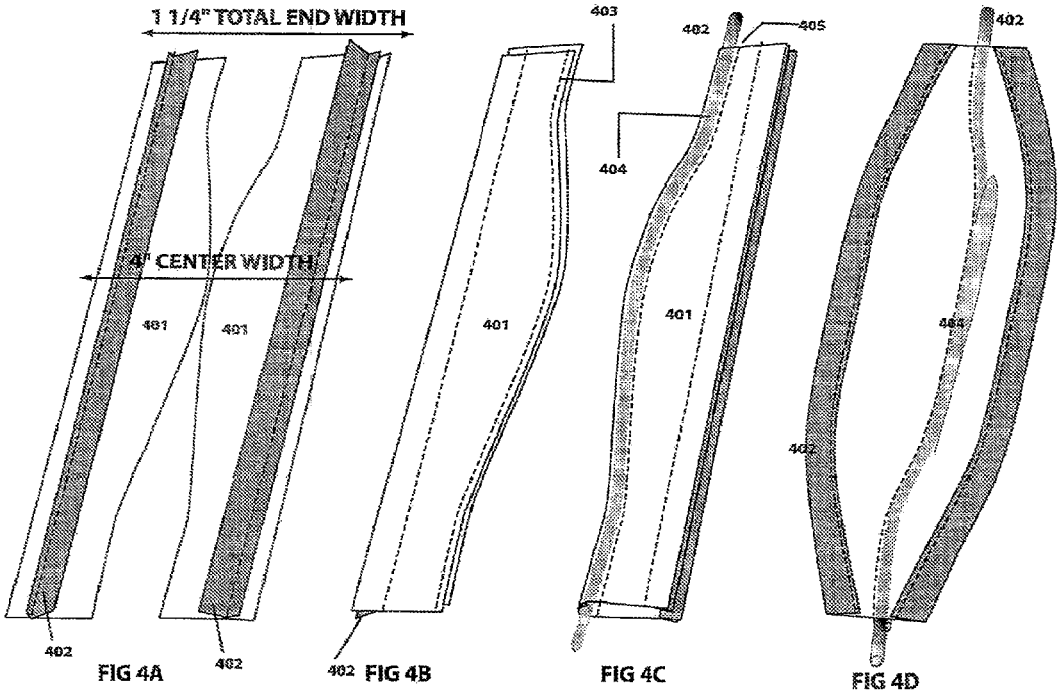
FIGS. 4A-4F illustrate a "hammock" shaped gusset embodiment comprising a no-catch mechanism.
Figure 4:
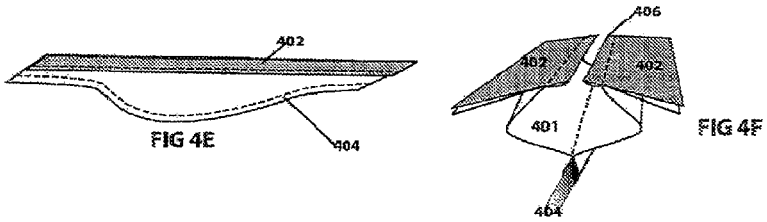

FIG. 4 illustrates an alternate gusset embodiment comprising a no-catch venting mechanism with a shape that extends toward the middle (i.e., a "hammock" shape). FIG. 4*a* illustrates two pieces of mesh gusset 401, with shell facings 402 sewn to the sides. FIG. 4*b* illustrates the curved sides of mesh gussets 401 stitched together right side to right side by stitching 403. FIG. 4*c* illustrates mesh gussets 401 folded back (as shown). No-catch mechanism 404 is enclosed by stitching 405 along the center of the gusset. Stitching 405 aids in dropping the gusset lower (thereby further preventing a fastener catch), and also aids in ventilation. FIG. 4*d* illustrates the two pieces of mesh gusset 401, shell facings 402, and set off no-catch mechanism 404 combining to form an opening. FIG. 4*e* illustrates the side view of the hammock gusset, with shell facing 402 at top and no-catch mechanism 404 dropping below. FIG. 4*f* illustrates a cross-section of mesh gusset 401 before being set under the fastener. Shell facings 402 are located under the fastener, and no-catch mechanism 404 pulls mesh gusset 401 away from the fastener. The combination of pin-tucks 406 and no-catch mechanism 404 create the accordion effect of mesh gusset 401.

The hammock-shaped gusset 401, as detailed in FIG. 4*c*, may include a pintucked shock cord 402 that is longer than the length of the fastener (e.g., a zipper). This causes shock cord 402 to drop away from the fastener, thereby preventing a fastener catch. See FIG. 4*e*.

While the present invention has been described with reference to the aforementioned applications, this description of the preferred embodiments is not meant to be construed in a limiting sense. It shall be understood that all aspects of the present invention are not limited to the specific depictions, configurations or dimensions set forth herein which depend upon a variety of principles and variables. It shall not be limited by sewing construction, and may be constructed by other means, such as, for example, but not limited to, glue. Various modifications in form and detail of the disclosed apparatus, as well as other variations of the present invention, will be apparent to a person skilled in the art upon reference to the present disclosure. It is therefore contemplated that any such modifications or variations of the described embodiments fall within the true spirit and scope of the present invention. It shall be understood that the invention may not be limited to application in apparel, but may be applied and utilized in other products, such as tents, sleeping bags, and backpacks.

What is claimed is:

1. A garment, comprising:

a zipper, which when in a fully unzipped configuration, exposes a venting mechanism attached to and completely surrounded by the zipper when the zipper is in a fully unzipped configuration, the zipper being located on the garment, wherein the venting mechanism comprises:

an oblong-shaped opening generally having an orientation concurrent to an orientation of the zipper, and a mesh fabric set inside the opening; and a no-catch mechanism attached to said mesh fabric to pull and secure the mesh fabric away from the zipper, wherein a central portion of the mesh fabric is joined together to enclose the no-catch mechanism.

2. The garment of claim 1, wherein the mesh fabric arrangement comprises a first portion and a second portion that together form a gusset.

3. The garment of claim 1, wherein the no-catch mechanism is set away from the zipper to prevent a zipper catch.

4. The garment of claim 1, wherein a length of the no-catch mechanism is longer than a length of the zipper.

5. The garment of claim 1, wherein the no-catch mechanism is an elastic cord.

6. The garment of claim 1, wherein the central portion of the mesh fabric forms piping.

7. The garment apparatus of claim 1, wherein the venting mechanism further comprises:

a first shell fabric attached to the mesh fabric, where a first edge of said first shell fabric meets a first edge of the mesh fabric; and a second shell fabric attached to the mesh fabric, where a first edge of said second shell fabric meets a second edge of the mesh fabric.

8. The garment of claim 7, wherein the zipper is attached to the first shell fabric and the second shell fabric.

9. The garment of claim 1, wherein the central portion of the mesh fabric is joined together by stitching.

10. A ventilated garment, comprising:

an oblong-shaped vent opening formed on the garment;

a mesh fabric arranged within the vent opening, said mesh fabric being sewn together at a central portion to form a piping enclosure;

a no catch mechanism located within the piping enclosure; and a zipper completely surrounding the vent opening when in a fully unzipped configuration and arranged to close the vent opening when in a zipped configuration.

11. The ventilated garment of claim 10, wherein the no catch mechanism is an elastic cord.

* * * * *